United States Patent [19]

Lamansky

[11] Patent Number: 4,561,635

[45] Date of Patent: Dec. 31, 1985

[54] NAIL REMOVING HAMMER

[76] Inventor: Daniel R. Lamansky, R.R. 2, Fairfield, Iowa 52556

[21] Appl. No.: 554,575

[22] Filed: Nov. 23, 1983

Related U.S. Application Data

[63] Continuation-in-part of Ser. No. 421,234, Sep. 22, 1982, Pat. No. 4,482,132, and Ser. No. 391,528, Jun. 24, 1982, abandoned.

[51] Int. Cl.[4] ..... B25C 11/00

[52] U.S. Cl. ..... 254/26 R

[58] Field of Search ..... 254/26 R, 25; 145/29 R, 145/30 R

[56] References Cited

U.S. PATENT DOCUMENTS

| | | | |
|---|---|---|---|
| 210,041 | 11/1878 | Knauer | 254/26 R |
| 468,892 | 2/1892 | Palmer | 254/26 R |
| 675,823 | 6/1901 | Edmonds | 145/30 R |
| 994,775 | 6/1911 | Nelson | 254/26 R |
| 1,114,910 | 10/1914 | Reed | 254/26 R |
| 1,660,237 | 2/1928 | Small | 254/26 R |

*Primary Examiner*—Robert C. Watson

*Attorney, Agent, or Firm*—Seiler, Quirk, & Tratos

[57] ABSTRACT

A nail-removing hammer has at least one sidewardly opening claw located just behind the poll portion of the hammer head. The claw is formed from a transverse bore in the side of the head, and a pair of jaws at the top of the head which are situated over the bore. The jaws are preferably defined by V-shaped flanges extending over a portion of the bore. Similar sidewardly opening claws may optionally be mounted in the throat.

7 Claims, 9 Drawing Figures

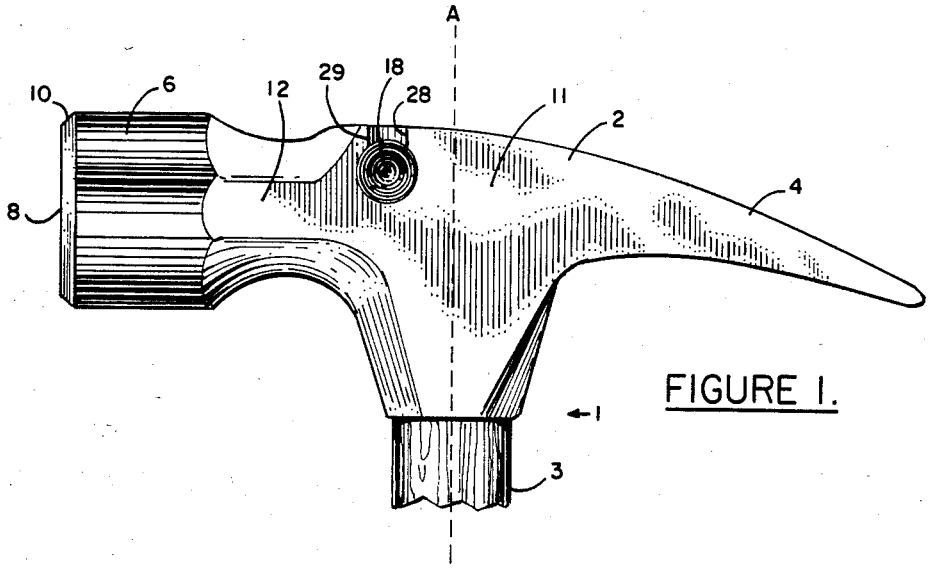
FIGURE 1.
FIGURE 2.
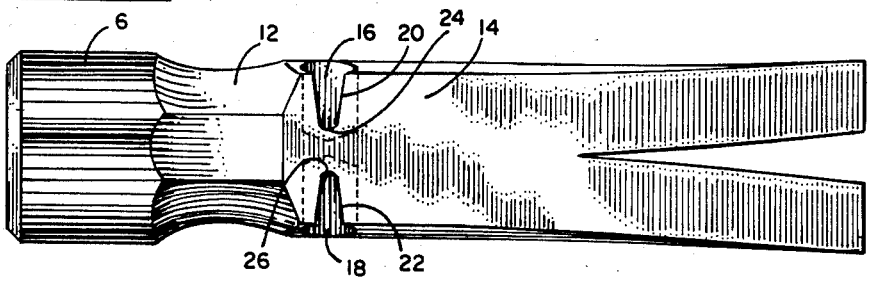
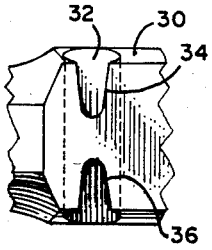
FIGURE 3.
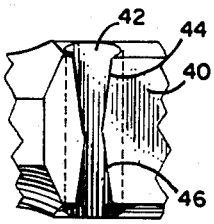
FIGURE 4.
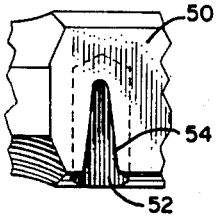
FIGURE 5.
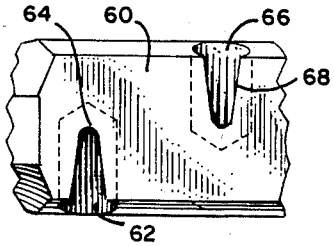
FIGURE 6.
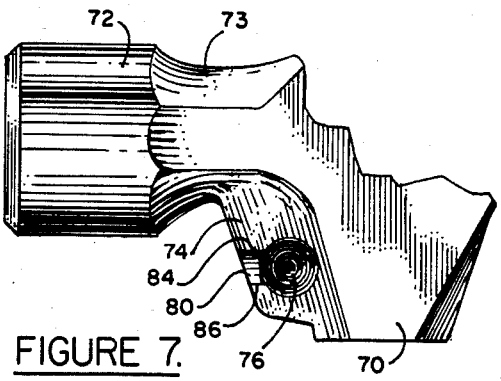
FIGURE 7.
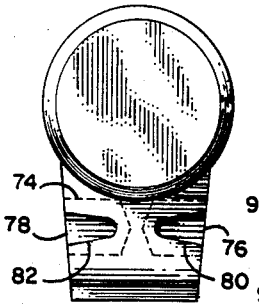
FIGURE 8.
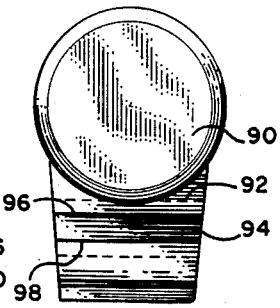
FIGURE 9.

NAIL REMOVING HAMMER

RELATIONSHIP TO OTHER CASES

This invention is a continuation-in-part of application Ser. No. 421,234, filed Sept. 22, 1982, now U.S. Pat. No. 4,482,132 entitled "Nail Removing Hammer," and of application Ser. No. 391,528, filed June 24, 1982, now abandoned, entitled "Nail Removing Tool."

BACKGROUND OF THE INVENTION

This invention relates to a nail removing hammer which has at least one nail removing means in addition to a conventional rearwardly extending claw. More particularly, the invention relates to a hammer having particular utility for removing a double-head nail and other nails which are difficult to remove.

Hammers having standard claws are generally limited in mechanical advantage for pulling nails. Nails which are particularly difficult to remove such as double-head nails (sometimes referred to as "duplex" or "scaffold" nails), glue coated nails, nails having ribbed shanks, and other large nails, are particularly problematic for conventional clawed hammers to remove because the nail is located at a relatively long distance from the fulcrum of rotation, thereby requiring a very large rotational force to begin the nail removal process. The removal of a very large number of scaffold nails with a conventional nail-removing tool is extremely tiring.

The hammer of the invention has at least one claw in addition to the conventional rearwardly extending forked claw. The additional claw is a side entry notch in the top portion of the hammer head, and is located rearwardly from the poll, and just forwardly of a longitudinal plane extending through the center of the hammer handle. The claw is designed to remove nails which have a head portion already extending above the wood surface, and provides a very large mechanical advantage for the initial (and most difficult) portion of removal of the nail. The hammer of the invention optionally has an additional claw located in the throat portion of the hammer which is also accessible from the side of the hammer for continuing the removal of the nail after the initial portion of its removal. This claw is particularly useful for the removal of long nails.

The problem of removing long nails with standard-claw hammers has been recognized for many years. One approach to solving the problem is to have a movable arm which extends outwardly from the top of the hammer and which can act as a fulcrum (thus replacing the block of wood) when pulling long nails. Examples of tools having this capability are shown in U.S. patents Thayer, U.S. Pat. No. 35,715, Shepard, U.S. Pat. No. 587,242, Palmer, U.S. Pat. No. 856,097, Frey, U.S. Pat. No. 1,125,999, Eveleth, U.S. Pat. No. 540,967, and Rairden, U.S. Pat. No. 1,132,879. While these devices provide additional leverage for removing long nails, the requirement of having moving parts generally makes the hammers somewhat more expensive and less durable. In addition, each time a long nail must be removed, the hammer must be adjusted to provide for the extended fulcrum.

It is also known to incorporate various types of nail-extracting devices in addition to or in replacement of a standard claw for hammers or similar hand tools. For example, in David, U.S. Pat. No. 3,150,858, a straight-claw hammer having two additional claws with openings circumferential to the hammer head is disclosed. The nail is removed by engaging the head in the claw and rotating the hammer around the axis of the hammer head, in effect wrapping the nail around the hammer body. Additional torque must be applied by hand since the fulcrum is off-center to the handle. Furthermore, this device is not adapted to remove nails in tight places. Similar devices showing claws which engage the nail and are rotated about the body axis to to remove the nail are found in Darr et al, U.S. Pat. No. 1,600,275, and Chase, U.S. Pat. No. 516,644. In Thorson, U.S. Pat. No. 1,656,652, Darr et al, U.S. Pat. No. 1,600,275, and Andersen, U.S. Pat. No. 1,713,810, tools are disclosed having notches in side portions of conventional hammer claws which are used to engage nails for removal. Both of these tools are used in the standard manner, i.e., rotation of handle over head, as is experienced with a conventional claw hammer. A further unusual claw design including a plurality of transverse slots in a rearwardly extending claw member is disclosed in Connor, U.S. Pat. No. 3,963,215.

Treat, U.S. Pat. No. 587,623, shows a throat-located claw for removing long nails which is accessible from the top portion of the claw immediately beneath the hammer poll. Knight, U.S. Pat. No. 638,341, shows a similar claw accessible from the bottom portion of the claw which is located underneath the conventional curved claw at the back of the hammer. Hebblethwaite, U.S. Pat. No. 529,384, shows a claw in the curved rearward portion of the hammer similar to a forked claw, with the claw being formed by a cavity at the rear portion of the hammer rather than the conventional open dual-forked claw.

Accordingly, it is an object of the present invention to provide a hammer having a large mechanical advantage for the extraction of nails which are difficult to remove. It is a further object of the invention to provide a hammer which provides a nail-removing claw having a substantially greater mechanical advantage than conventional hammers. It is another object of the invention to provide a hammer which is durable, yet very easy and inexpensive to manufacture. These and other objects of the invention will be apparent from the following description of several preferred embodiments of the hammer of the invention.

BRIEF SUMMARY OF THE INVENTION

A nail-removing hammer has at least one additional nail-removing means at a rear portion of the hammer poll. The nail-removing means is a side entry notch or slot in hammer head between the poll and the handle axis and is designed to engage a nail head which is alread slightly above the surface of the wood. The nail-removing means may consist of separate notches on either side of the hammer head, which may or may not be longitudinally disposed from each other along the head. Removal of the nail is effected by sliding the hammer head sidewardly until the nail head engages the nail-removing slot or channel, and rotating the hammer handle in a handle over head direction. A similar side entry claw is optionally located in the hammer throat, and removal of a nail with the throat claw is effected by engaging the nail in a similar manner to the top claw, and rotating the hammer handle in a head over handle location.

BRIEF DESCRIPTION OF THE DRAWINGS

The invention is best understood with reference to the drawings, in which:

FIG. 1 is a partial side elevational view of a hammer of the invention having an additional claw in the head;

FIG. 2 is a top view of the hammer of FIG. 1;

FIG. 3 is a top view of an alternate embodiment of the hammer of FIG. 1 with a channel extending transversely across the entire hammer head;

FIG. 4 is a partial top view of an embodiment similar to FIG. 3 with a nail-receiving flange which is open across the entire top portion of the head;

FIG. 5 shows a single side entry claw at the top of the hammer which is useful for a right-handed carpenter;

FIG. 6 is a partial view of an alternate embodiment wherein the side entry claws at the top are longitudinally displaced along the hammer head;

FIG. 7 is a partial side view of a hammer having a side entry claw in the throat in addition to the claw at the top of the head;

FIG. 8 is a front view of the head of FIG. 7; and

FIG. 9 is an alternate design to the design shown in FIG. 8 wherein the nail-gripping flange is open across the entire width of the hammer head.

DETAILED DESCRIPTION OF PREFERRED EMBODIMENTS

Referring to FIG. 1, a nail-extracting hammer of the invention has a head 2, a wood handle 3, and a standard, rearwardly extending, forked claw 4. A strike portion or poll 6 having a strike face 8 is located at the forward portion of the hammer head. The poll is circular and has a chamfered surface 10 around the edge of the poll face which serves as a pivot point when either the head claw or throat claw of the invention is used. The head claw and throat claw of the invention both comprise bores which extend inwardly from the side portion or cheek 11 of the hammer head. A neck portion 12 extends between the rear of the poll and the remainder of the head body. For descriptive purposes, the poll portion of the hammer head is referred to as the forward portion, and the conventional forked claw portion 4 is referred to as the rearward portion. Similarly, the top of the poll is described as the upper portion of the head, whereas the socket entrance where the wood handle inserts is considered to be the lower portion of the head. This description, which is for convenient reference purposes only, should not be considered as limiting. Similarly, while the hammer is described as shown with a metal head and wood handle, the invention is equally applicable to any hammer, such as a single-piece forged or cast metal handle construction.

According to the invention, the hammer depicted in FIGS. 1 and 2 has a pair of side entry nail-removing means located on opposing sides of the hammer at the top surface 14 of the hammer head. The nail-removing means are pairs of jaws defined by V-shaped slots 20 and 22 having curved rearward portions 24 and 26, respectively. The slots are formed from flanges extending over a portion of the outside portion of the bore and open outwardly toward the sides of the hammer. A pair of generally cylindrical bores 16 and 18 are drilled toward the center of the hammer head and serve as nail-head receiving chambers. As is seen in FIG. 1, the top of the cylindrical bore is located about $\frac{1}{8}$" below the upper surface 14 of the head, providing the jaw 22 with relatively thick vertical side walls 28 and 29 which contribute great strength and durability to the jaws. As is apparent from FIG. 2, the opening of the notch or slot is from about $\frac{1}{2}$ to about $\frac{3}{4}$, and preferably about $\frac{2}{3}$, of the diameter of the head receiving bore.

In order to maintain a favorable mechanical advantage to enable the easy removal of nails which require great force to remove, the placement of the side entry nail-removing means in the upper surface of the hammer head is very important. In FIG. 1, the vertical dashed line "A" designates a plane extending transverse to the hammer head through the center of the hammer handle and is also referred to as the axis of the hammer handle. The side entry jaw of FIG. 1 is located rearwardly of the poll of the hammer and forwardly of the handle axis, thereby providing great leverage for the initial removal of long or difficult nails. Once the removal is started with the top claw, for long nails the removal may be completed by use of the throat claw shown in FIGS. 7 through 9.

FIGS. 3 through 6 represent variations on the side entry claws shown in FIGS. 1 and 2. In FIG. 3, hammer head 30 has two similar opposing V-shaped jaws 34 and 36, and a single transverse bore 32 which extends entirely across the width of the hammer head. While this design is slightly easier to make, requiring only a single bore through the hammer head, it may have slightly less strength and durability than the hammer shown in FIG. 1. Hammer head 40, a partial view of which is shown in FIG. 4, is similar to the design of FIG. 3 in that the bore 42 extends entirely across the width of the hammer head, but differs in that the V-shaped jaws 44 and 46 interconnect at their rear portions to form an "X"-shaped channel which extends across the entire width of the head. In this design, the nail head is slid into the side opening of the jaw, and is moved into the jaw until the nail shank is gripped by the opposing sides of the jaw. Hammer head 50, shown partially in FIG. 5, has only a single V-shaped notch 54 located above a cylindrical bore 52 which extends more than half way, but less than completely, through the width of the hammer head. In general, the notch on the left side of the hammer head is particularly useful for right-handed carpenters. For left-handed carpenters, the head would have a notch on the opposite side from the one shown in FIG. 5. In FIG. 6, two opposing side entry V-shaped claws are longitudinally disposed from each other along the top of the hammer head. V-shaped claw 64 and head receiving bore 62 are located just forwardly of the handle axis, while V-shaped claw 68 and bore 66 are located immediately rearwardly of the handle axis. This design enables a carpenter to select one of two side entry claws depending on the particular level of mechanical advantage desired. In the design of FIG. 6, claw 64 has a greater mechanical advantage, but lesser length of removal for equivalent handle movement than claw 68.

All of the hammers of the invention have at least one top side entry claw as shown in FIGS. 1 through 6. In addition, the hammers may have a side entry claw in the throat of the hammer head of the type shown in FIGS. 7 through 9. Hammer head 70 shown in FIG. 7 has a poll portion 72, neck 73, and throat 74. As shown, the throat has a front surface which angles forwardly and upwardly toward the poll. A pair of opposing V-shaped jaws 80 and 82 are located beneath the poll in the throat portion of the hammer 70. The claws are formed similarly to the claws shown in FIG. 1, with transverse bores 76 and 78 extending toward the interior of the throat to form side entry nail head receiving chambers. As shown in FIG. 7, V-shaped claw 80 is formed from jaws 84 and 86 which are relatively thick (e.g., about $\frac{1}{8}$") for strength and durability. FIG. 9 shows a variation of the side entry claws of FIGS. 7 and 8 wherein hammer 90 has a transverse cylindrical bore 94 which extends across the entire width of throat 92. The claw is formed from opposing parallel jaws 96 and 98 which form a uniform slot which extends across the front of the throat. The slot has a width approximately equal to $\frac{1}{2}$ the diameter of the cylindrical bore. In this manner, the nail head is inserted into the bore from either side, with the shank of the nail extending through the jaws 96 and 98. Upon rotation of the hammer handle, the underside of the nail head rests on the inside ledge of the jaws, thereby gripping the head for removal.

The throat claw design shown in FIGS. 8 and 9 may be modified to other side-entry configurations, and can be designed in like manner to the top claws shown in FIGS. 3–5.

To use the hammer of the invention, a nail head must first be elevated to at least about $\frac{1}{8}$" above the surface from which it is to be removed. This may be done with a conventional "cat's paw" or other starter tool. On the other hand, if the nail is a double-head nail or a nail which was bent while it was being driven and thus must be removed, the head is already sufficiently above the surface to enable the hammer to be used as the first removal tool. To remove the nail, the hammer head is moved laterally such that the nail head engages the side entry chamber, with the nail shank extending outwardly through the V-shaped jaw shown in FIGS. 1 through 6. The hammer is then rotated in handle-over-head direction with the chamfered section 10 acting as pivot point. The mechanical advantage is very large in this configuration, since the distance from the chamfer to the claw 22 is only a fraction of the length of the hammer handle. After the nail has been removed to its maximum distance with the claw at the top of the hammer head, the head may be inserted in the throat claw shown in FIGS. 7 through 9 in like manner to complete the removal by rotating the hammer in the opposite direction (i.e., handle over claw).

The hammer of the invention is particularly easy to manufacture, since the cylindrical nail-receiving chamber is easily bored with a drill; alternatively, the head is easily cast in this configuration.

In addition, many modifications and variations of the nail-extracting hammer disclosed herein will be apparent to those skilled in the art within the spirit and scope of the invention. Accordingly, the foregoing description of preferred embodiments of the invention should be considered illustrative rather than limiting and the invention should be defined only by the following claims.

I claim:

1. A nail-removing hammer having a head portion and a handle having an axis extending outwardly from a lower portion of the head, the head comprising a forwardly extending poll and a rearwardly extending nail-extracting claw, nail-removing means located at the upper surface of the head rearwardly of the poll and forwardly of the handle axis comprising a transverse bore having walls in a side wall of the head portion, and a sidewardly opening notch at the upper portion of the bore, said hammer also comprising a sidewardly opening claw located in a throat portion of the hammer.

2. The hammer of claim 1 wherein the notch has a width less than the maximum width of the bore.

3. The hammer of claim 1 wherein the notch is substantially V-shaped.

4. The hammer of claim 1 having two V-shaped notches located on opposite sides of the hammer head.

5. The hammer of claim 1 wherein the sidewardly opening claw comprises a transverse bore and a sidewardly opening V-shaped notch opening into said bore.

6. The hammer of claim 1 also comprising a pair of opposing outwardly opening V-shaped notches in the throat portion of the hammer.

7. The hammer of claim 1 wherein the bore is cylindrical, and the nail-removing means comprisesa pair of jaws formed by flanges extending over an outward portion of the bore.

* * * * *